US009576522B2

(12) United States Patent
Kim et al.

(10) Patent No.: US 9,576,522 B2
(45) Date of Patent: Feb. 21, 2017

(54) ORGANIC LIGHT EMITTING DISPLAY

(71) Applicant: LG DISPLAY CO., LTD., Seoul (KR)

(72) Inventors: Jihun Kim, Paju-si (KR); Hyojin Park, Yeosu-si (KR)

(73) Assignee: LG DISPLAY CO., LTD., Seoul (KR)

( * ) Notice: Subject to any disclaimer, the term of this patent is extended or adjusted under 35 U.S.C. 154(b) by 325 days.

(21) Appl. No.: 13/941,966

(22) Filed: Jul. 15, 2013

(65) Prior Publication Data

US 2014/0184579 A1 Jul. 3, 2014

(30) Foreign Application Priority Data

Dec. 27, 2012 (KR) ..... 10-2012-0155407

(51) Int. Cl.
*G09G 5/00* (2006.01)
*G09G 3/32* (2016.01)

(52) U.S. Cl.
CPC .... *G09G 3/3208* (2013.01); *G09G 2300/0426* (2013.01); *G09G 2320/0209* (2013.01); *G09G 2320/0223* (2013.01)

(58) Field of Classification Search
CPC ..... G09G 3/3233
USPC ..... 345/76, 211, 212
See application file for complete search history.

(56) References Cited

U.S. PATENT DOCUMENTS

| | | | | |
|---|---|---|---|---|
| 8,368,690 | B1 * | 2/2013 | Hoppenstein et al. | 345/419 |
| 2008/0290814 | A1 * | 11/2008 | Leong | F21K 9/00 315/294 |
| 2009/0079469 | A1 * | 3/2009 | Ogata | H01L 27/0203 326/38 |
| 2010/0177086 | A1 * | 7/2010 | Nakamura et al. | 345/211 |
| 2010/0188391 | A1 * | 7/2010 | Kim | 345/212 |
| 2011/0128262 | A1 | 6/2011 | Chaji et al. | |
| 2012/0038605 | A1 | 2/2012 | Han | |

FOREIGN PATENT DOCUMENTS

| | | | |
|---|---|---|---|
| CN | 101866614 | A | 10/2010 |
| JP | 2004-356052 | A | 12/2004 |
| JP | 2008-46619 | A | 2/2008 |
| JP | 2010-134484 | A | 6/2010 |
| JP | 2010-164619 | A | 7/2010 |
| JP | 2011-145651 | A | 7/2011 |
| JP | 2012-108192 | A | 6/2012 |

* cited by examiner

*Primary Examiner* — Calvin C Ma
(74) *Attorney, Agent, or Firm* — Dentons US LLP

(57) ABSTRACT

An organic light emitting display includes a plurality of pixels formed at crossings of data lines and gate line parts and a main power supply line part supplying a cell driving voltage to the pixels. The main power supply line part includes a plurality of main power supply lines disposed along a first direction and main power supply line connection patterns for connecting the adjacent main power supply lines along a second direction substantially perpendicular to the first direction. The main power supply line connection patterns are staggered along the second direction.

16 Claims, 21 Drawing Sheets

ORGANIC LIGHT EMITTING DISPLAY

This application claims the benefit of Korea Patent Application No. 10-2012-0155407 filed on Dec. 27, 2012, which is incorporated herein by reference for all purposes as if fully set forth herein.

BACKGROUND OF THE INVENTION

Field of the Invention

Embodiments of the invention relate to an organic light emitting display and more particularly to a structure of power supply lines of an organic light emitting display.

Discussion of the Related Art

An active matrix organic light emitting display includes organic light emitting diodes (hereinafter, abbreviated to "OLEDs") capable of emitting light by itself and has advantages of a fast response time, a high light emitting efficiency, a high luminance, a wide viewing angle, etc.

The OLED serving as a self-emitting element includes an anode electrode, a cathode electrode, and an organic compound layer formed between the anode electrode and the cathode electrode. The organic compound layer includes a hole injection layer, a hole transport layer, a light emitting layer, an electron transport layer, and an electron injection layer. When a driving voltage is applied to the anode electrode and the cathode electrode, holes passing through the hole transport layer and electrons passing through the electron transport layer move to the light emitting layer and form excitons. As a result, the light emitting layer generates visible light.

The organic light emitting display arranges pixels, each including the OLED in a matrix form, and represents a gray scale by controlling an amount of current flowing in the OLEDs. In the organic light emitting display, an amount of voltage change differs depending on an amount of current flowing in power supply lines of a display panel. The voltage change includes voltage drop and voltage rising. The power supply voltage is lower than an original input value by voltage drop, and is higher than the original input value by voltage rising.

The power supply lines include high potential cell driving voltage supply lines (hereinafter referred to as "ELVDD supply lines") for supplying a high potential cell driving voltage ELVDD to a driving thin film transistor (TFT) of each pixel. If desired, the power supply lines may further include auxiliary power supply lines, such as initialization voltage supply lines (hereinafter referred to as "Vint supply lines") for supplying an initialization voltage Vint to each pixel and reference voltage supply lines (hereinafter referred to as "Vref supply lines") for supplying a reference voltage Vref to each pixel.

As shown in FIG. 1, the ELVDD supply lines may be disposed on the display panel along a Y-axis direction in which data lines of the display panel extend. Two pixels, which are positioned adjacent to each other in an X-axis direction, may share one ELVDD supply line with each other, so as to improve an aperture ratio. An amount of voltage change varies depending on a pattern of an image displayed on the display panel. For example, an amount of voltage change in a bright image pattern is greater than an amount of voltage change in a dark image pattern. In particular, as shown in FIG. 2, when a motion picture is implemented and a bright image pattern (A) surrounded by a dark image pattern (B) moves to the right (or the left) at a rapid speed, characteristics of the voltage change vary depending on an image pattern variation of the display panel. Therefore, a moving vertical crosstalk is generated in the display panel.

FIG. 3 shows a boundary of the bright image pattern (A) in a measuring pattern of the vertical crosstalk in detail. A voltage distribution on the power supply lines at the boundary of the bright image pattern (A) shown in FIG. 3 is substantially the same as that shown in FIG. 4. As can be seen from FIGS. 3 and 4, a degree of the voltage drop in the bright image pattern (A), i.e., patterns ⓒ and ⓓ, is greater than a degree of the voltage drop in the dark image pattern (B), i.e., patterns ⓐ and ⓑ. Further, even if both the patterns ⓒ and ⓓ belong to the same bright image pattern (A), degrees of the voltage drop in the patterns ⓒ and ⓓ may be different from each other depending on light emitting colors of pixels implementing each of the patterns ⓒ and ⓓ. A voltage difference between the power supply lines resulting from the voltage drop leads to undesirable luminance difference between the pixels, and thus the vertical crosstalk shown in FIG. 2 appears on the display panel.

As shown in FIG. 5, the ELVDD supply lines may be disposed in a mesh structure, so as to minimize an amount of the voltage change. In the mesh structure, the ELVDD supply lines are disposed on the display panel in the X-axis direction as well as the Y-axis direction. When the ELVDD supply lines are formed in the mesh structure, the display panel may be entirely burnt when a short is generated between the ELVDD supply lines and other lines at any position inside the display panel. Thus, the reliability of the organic light emitting display may be compromised. Further, when the mesh structure is used, a thermal transfer path in the X-axis direction greatly shortens. Therefore, as shown in FIG. 9, an ignition at any one crossing of the display panel may be easily transferred to another crossing adjacent to the one crossing.

The Vint supply lines and the Vref supply lines may be disposed as shown in FIG. 6, or may be disposed in the mesh structure as shown in FIG. 7 so as to improve an aperture ratio. When the Vint supply lines and the Vref supply lines are formed as shown in FIG. 6, the above-described problems resulting from the voltage change are generated. When the Vint supply lines and the Vref supply lines are formed in the mesh structure as shown in FIG. 7, a horizontal crosstalk is generated by capacitive coupling at crossings between the data lines and the auxiliary power supply lines.

As shown in FIGS. 8 and 9, a level of a data voltage Vdatal sharply changes at a boundary between a background pattern and a box pattern, each of which has a different gray level. In this instance, a capacitive coupling is generated between the data lines and the auxiliary power supply lines and thus swings the reference voltage Vref. Because the auxiliary power supply lines having the mesh structure are connected to one another in the X-axis direction as well as the Y-axis direction, the swinging reference voltage Vref is spread in the X-axis direction. A ripple component of the reference voltage Vref affects operations of all of the pixels positioned around a boundary of the box pattern and thus leads to the horizontal crosstalk.

Further, when a short is generated between the auxiliary power supply lines and other lines at any position of the display panel, a high short current resulting from a voltage difference between the shorted lines and a low short resistance locally flows in the display panel. Hence, heat is generated in the short point of the display panel. As shown in FIG. 10, when the auxiliary power supply lines are disposed in a mesh structure, such a heat may be transferred to left and right and top and bottom. Hence, a temperature around the shorted position of the display panel sharply increases, and the display panel may be entirely burnt.

SUMMARY OF THE INVENTION

Embodiments of the invention provide an organic light emitting display capable of improving image quality and preventing a diffusion of burning by changing a disposition structure of power supply lines.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

In one aspect, there is an organic light emitting display comprising a plurality of pixels formed at crossings of data lines and gate line parts, and a main power supply line part configured to supply a cell driving voltage to the pixels, the main power supply line part including a plurality of main power supply lines extended along a first direction and main power supply line connection patterns for connecting the adjacent main power supply lines along a second direction substantially perpendicular to the first direction, wherein the main power supply line connection patterns are staggered along the second direction.

The main power supply line part includes an ELVDD supply line part configured to supply a high potential cell driving voltage ELVDD to the pixels and an ELVSS supply line part configured to supply a low potential cell driving voltage ELVSS to the pixels. The main power supply line connection patterns include ELVDD supply line connection patterns for connecting adjacent ELVDD supply lines along the second direction and ELVSS supply line connection patterns for connecting adjacent ELVSS supply lines along the second direction.

The number of ELVDD supply line connection patterns disposed between first and second ELVDD supply lines, which are positioned adjacent to each other in the second direction, is less than a vertical resolution of a display panel.

When the vertical resolution of the display panel is '1080', the number of ELVDD supply line connection patterns disposed between the first and second ELVDD supply lines is about 5 to about 20.

The ELVDD supply line connection patterns are disposed between the first and second ELVDD supply lines at regular intervals along the first direction.

The ELVDD supply line connection patterns are disposed between the first and second ELVDD supply lines at irregular intervals along the second direction.

The organic light emitting display further comprises a Vint supply line part configured to supply an initialization voltage Vint to the pixels, the Vint supply line part including a plurality of Vint supply lines disposed along the first direction and Vint supply line connection patterns for connecting the adjacent Vint supply lines along the second direction, and a Vref supply line part configured to supply a reference voltage Vref to the pixels, the Vref supply line part including a plurality of Vref supply lines disposed along the first direction and Vref supply line connection patterns for connecting the adjacent Vref supply lines along the second direction. The Vint supply line connection patterns are staggered along the second direction, and the Vref supply line connection patterns are staggered along the second direction.

The number of Vint supply line connection patterns disposed between first and second Vint supply lines, which are positioned adjacent to each other in the second direction, is less than a vertical resolution of a display panel. The number of Vref supply line connection patterns disposed between first and second Vref supply lines, which are positioned adjacent to each other in the second direction, is less than the vertical resolution of the display panel.

When the vertical resolution of the display panel is '1080', the number of Vint supply line connection patterns disposed between the first and second Vint supply lines is about 5 to about 20, and the number of Vref supply line connection patterns disposed between the first and second Vref supply lines is about 5 to about 20.

The Vint supply line connection patterns are disposed between the first and second Vint supply lines at regular intervals along the first direction, and the Vref supply line connection patterns are disposed between the first and second Vref supply lines at regular intervals along the first direction.

The Vint supply line connection patterns are disposed between the first and second Vint supply lines at irregular intervals along the first direction, and the Vref supply line connection patterns are disposed between the first and second Vref supply lines at irregular intervals along the first direction.

The first direction indicates a Y-axis direction in which the data lines extend, and the second direction indicates an X-axis direction in which the gate line parts extend.

Alternatively, the first direction indicates an X-axis direction in which the gate line parts extend, and the second direction indicates a Y-axis direction in which the data lines extend.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the invention, examples of which are illustrated in the accompanying drawings. Wherever possible, the same reference numbers will be used throughout the drawings to refer to the same or like parts.

Exemplary embodiments of the invention are described below with reference to FIGS. 11 to 18B.

Figure 11:
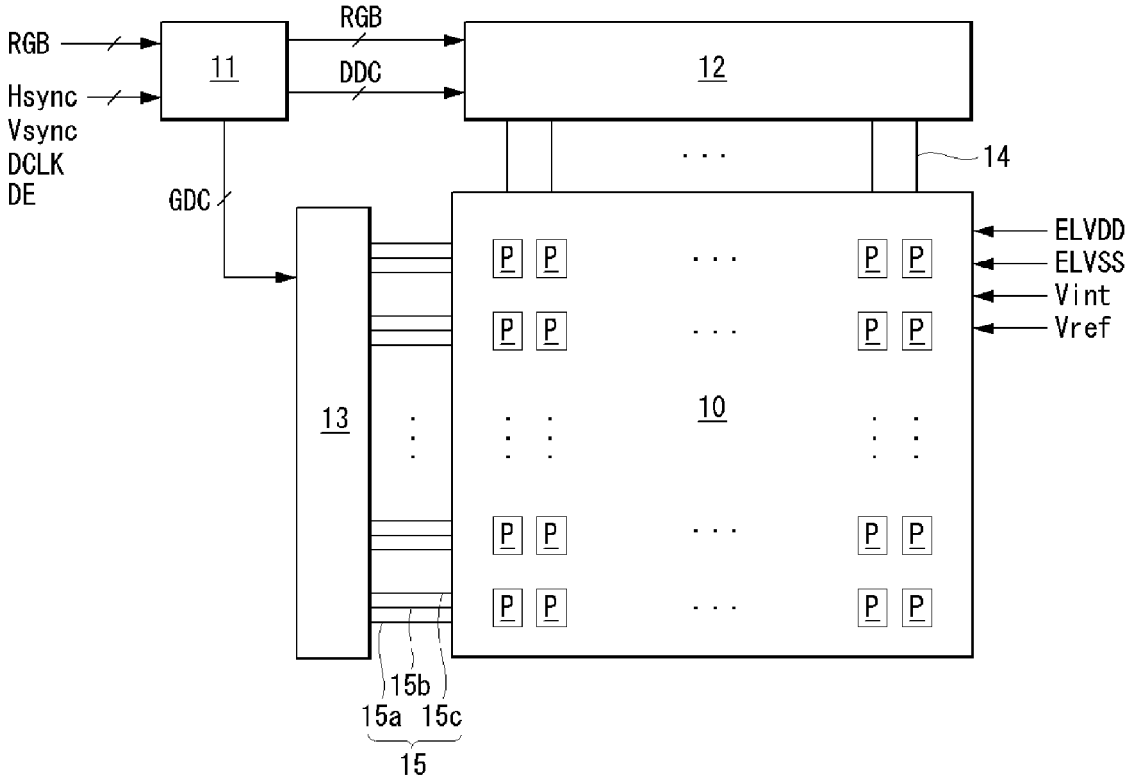
FIG. 11 illustrates an organic light emitting display according to an exemplary embodiment of the invention.

FIG. 11 illustrates an organic light emitting display according to an exemplary embodiment of the invention.

As shown in FIG. 11, an organic light emitting display according to an exemplary embodiment of the invention includes a display panel 10 in which a plurality of pixels P are arranged in a matrix, a data driving circuit 12 for driving a plurality of data lines 14 of the display panel 10, a gate driving circuit 13 for driving a plurality of gate line parts 15 of the display panel 10, and a timing controller 11 for controlling driving timing of the data driving circuit 12 and the gate driving circuit 13.

The display panel 10 includes the plurality of data lines 14, the plurality of gate line parts 15 crossing the data lines 14, and the plurality of pixels P respectively positioned at crossings of the data lines 14 and the gate line parts 15. Each gate line part 15 may include a scan line 15*a*, an emission line 15*b* and an initialization line 15*c*, depending on a structure of the pixel P. Each pixel P is connected to one data line 14 and the three signal lines 15*a*, 15*b*, and 15*c* constituting each gate line part 15. The pixels P receive a high potential cell driving voltage ELVDD, a low potential cell driving voltage ELVSS, a reference voltage Vref, and an initialization voltage Vint from a power source generator (not shown). For this, a main power supply line part for supplying the high potential cell driving voltage ELVDD and the low potential cell driving voltage ELVSS to the pixels P, a Vint supply line part for supplying the initialization voltage Vint to the pixels P, and a Vref supply line part for supplying the reference voltage Vref to the pixels P are formed in the display panel 10.

The main power supply line part is implemented in a semi-mesh structure so as to minimize an amount of voltage change and a diffusion of burning. The main power supply line part includes an ELVDD supply line part and an ELVSS supply line part. An auxiliary power supply line part including the Vint supply line part and the Vref supply line part is also implemented in a semi-mesh structure so as to minimize an amount of voltage change and a diffusion of burning.

The reference voltage Vref and the initialization voltage Vint may be set to be less than the low potential cell driving voltage ELVSS. The reference voltage Vref may be set to be greater than the initialization voltage Vint, and a difference between the reference voltage Vref and the initialization voltage Vint may be set to be greater than a threshold voltage of a driving thin film transistor (TFT) of each pixel P. Each pixel P may include an organic light emitting diode (OLED), a driving TFT, four switching TFTs, and two capacitors. For example, the pixel P may be designed to have the same structure as disclosed in detail in Korean Patent Application No. 10-2012-0095604 corresponding to the present applicant, which is hereby incorporated by reference in its entirety.

The timing controller 11 rearranges digital video data RGB received from the outside in conformity with a resolution of the display panel 10 and supplies the rearranged digital video data RGB to the data driving circuit 12. The timing controller 11 generates a data control signal DDC for controlling operation timing of the data driving circuit 12 and a gate control signal GDC for controlling operation timing of the gate driving circuit 13 based on timing signals, such as a vertical sync signal Vsync, a horizontal sync signal Hsync, a dot clock DCLK, and a data enable signal DE.

The data driving circuit 12 converts the digital video data RGB received from the timing controller 11 into an analog data voltage based on the data control signal DDC and supplies the data voltage to the data lines 14.

The gate driving circuit 13 generates a scan signal, an emission control signal, and an initialization signal based on the gate control signal GDC. The gate driving circuit 13 supplies the scan signal to the scan lines 15*a* in a line sequential manner, supplies the emission control signal to the emission lines 15*b* in the line sequential manner, and supplies the initialization signal to the initialization lines 15*c* in the line sequential manner. The gate driving circuit 13 may be directly formed in the display panel 10 in a GIP (Gate-driver In Panel) manner.

In the following description, the ELVDD supply line part will be described in detail as an exemplary structure of the main power supply line part. The structure of the ELVDD supply line part may be equally applied to the ELVSS supply line part. Thus, main power supply line connection patterns for connecting main power supply lines extending in a first direction may include ELVDD supply line connection patterns for connecting adjacent ELVDD supply lines along a second direction perpendicular to the first direction and ELVSS supply line connection patterns for connecting adjacent ELVSS supply lines along the second direction.

Figure 12:
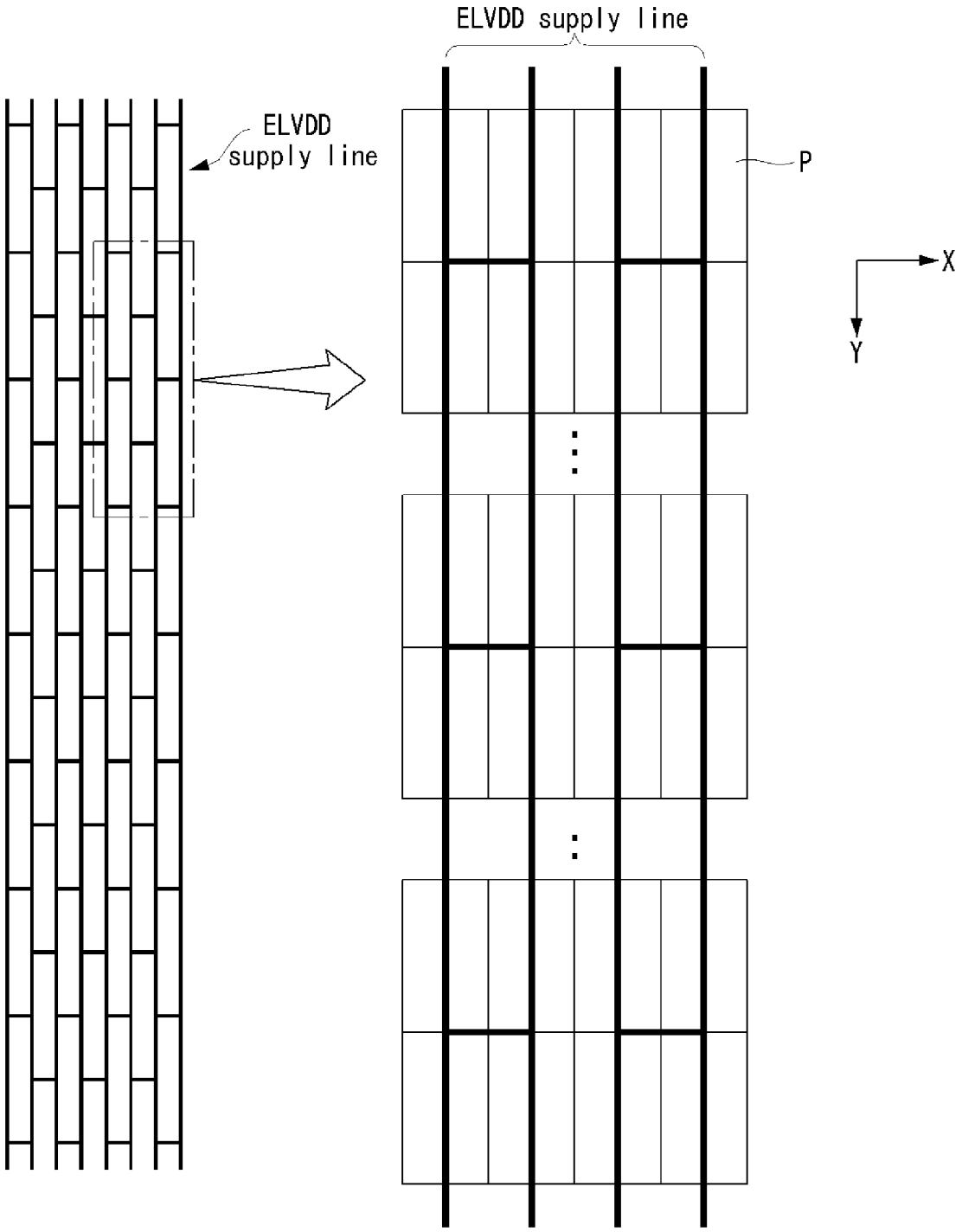
FIGS. 12, 13A, and 13B illustrate a disposition structure of an ELVDD supply line part according to an exemplary embodiment of the invention.
Figure 13A:
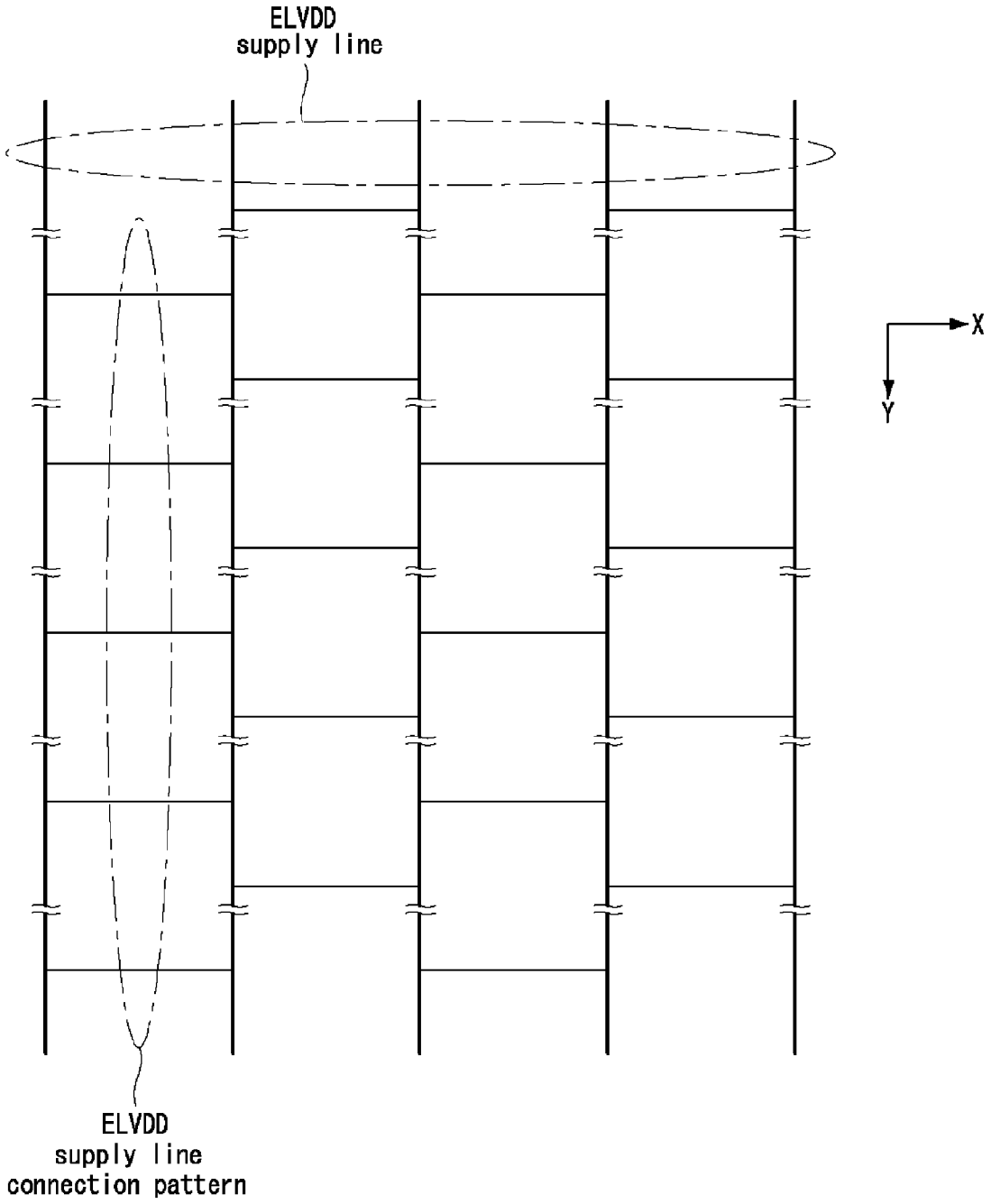
Figure 13B:
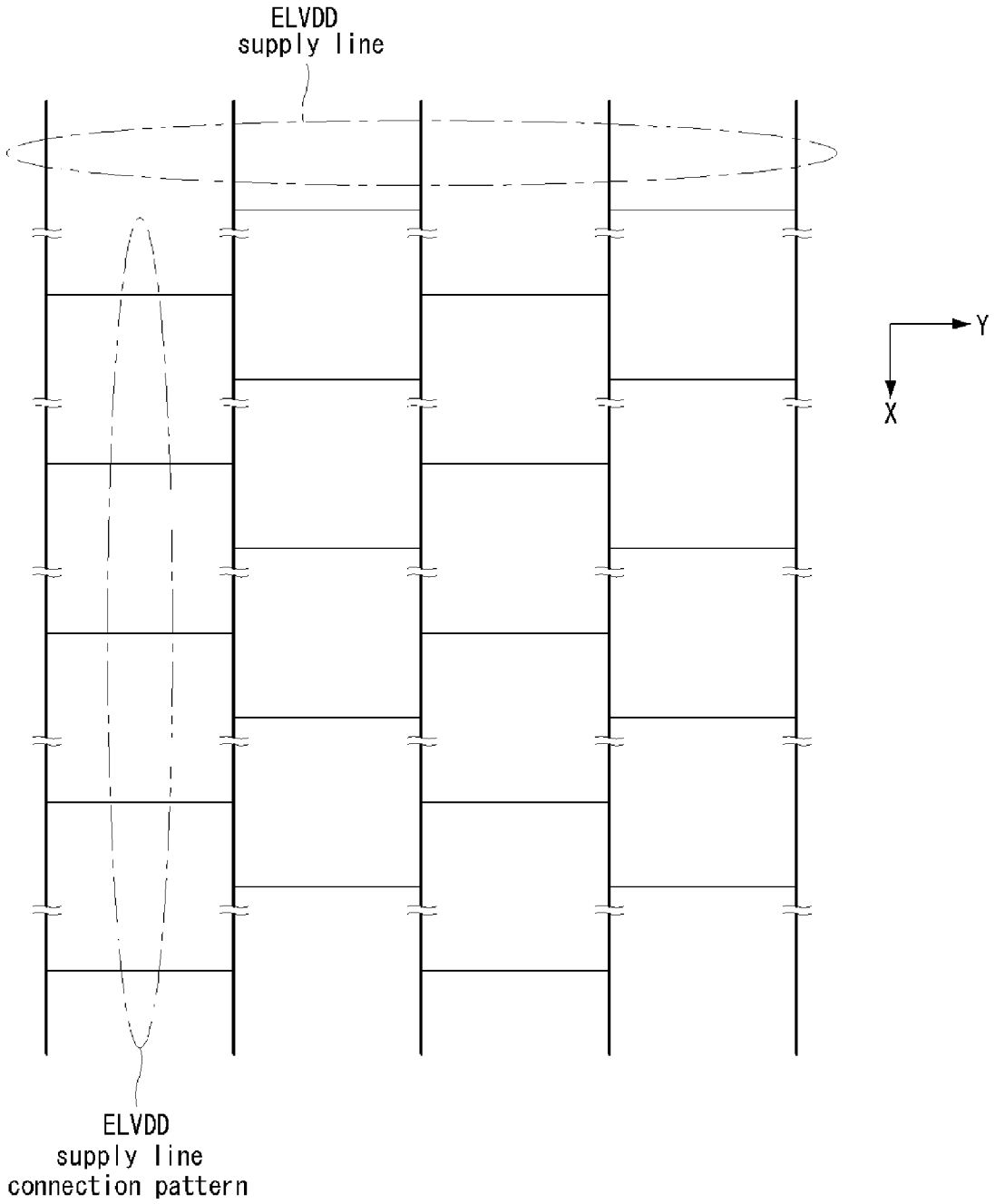

FIGS. 12, 13A, and 13B illustrate a disposition structure of the ELVDD supply lines according to an embodiment of the invention.

As shown in FIGS. 12 and 13A, the ELVDD supply line part according to an embodiment of the invention includes a plurality of ELVDD supply lines disposed along a Y-axis direction (i.e., an extension direction of the data line) and ELVDD supply line connection patterns for connecting the adjacent ELVDD supply lines along an X-axis direction (i.e., an extension direction of the gate line part) and thus forms a semi-mesh structure. In this instance, the ELVDD supply line connection patterns are staggered along the X-axis direction, thereby lengthening a thermal transfer path in the X-axis direction and increasing a line resistance in the X-axis direction.

One ELVDD supply line may be positioned in each pixel, or may be positioned in a number of pixels. For example, as shown in FIG. 12, one ELVDD supply line may be positioned in every two pixels (or at least three pixels) so as to improve an aperture ratio. The ELVDD supply line connection patterns may be disposed between first and second ELVDD supply lines which are positioned adjacent to each other in the X-axis direction. In this instance, the number of ELVDD supply line connection patterns between the first and second ELVDD supply lines may be less than a vertical resolution of the display panel. For example, when the vertical resolution of the display panel is '1080', the 5 to 20 ELVDD supply line connection patterns may be disposed between the first and second adjacent ELVDD supply lines. Further, the number of ELVDD supply line connection patterns positioned between the two adjacent ELVDD supply lines may vary depending on the size of the display panel, an amount of current flowing in the ELVDD supply lines, power characteristics of the pixels, etc.

The ELVDD supply line connection patterns may be disposed between the first and second ELVDD supply lines, which are adjacently positioned in the X-axis direction, at regular intervals or at irregular intervals along the Y-axis direction.

Alternatively, as shown in FIG. 13B, the ELVDD supply line part according to an embodiment of the invention includes a plurality of ELVDD supply lines disposed along the X-axis direction (i.e., the extension direction of the gate line part) and ELVDD supply line connection patterns for connecting the adjacent ELVDD supply lines along the Y-axis direction (i.e., the extension direction of the data line) and thus may form a semi-mesh structure. In this instance, the ELVDD supply line connection patterns are staggered along the Y-axis direction, thereby lengthening a thermal transfer path in the Y-axis direction and increasing a line resistance in the Y-axis direction.

Figure 14:
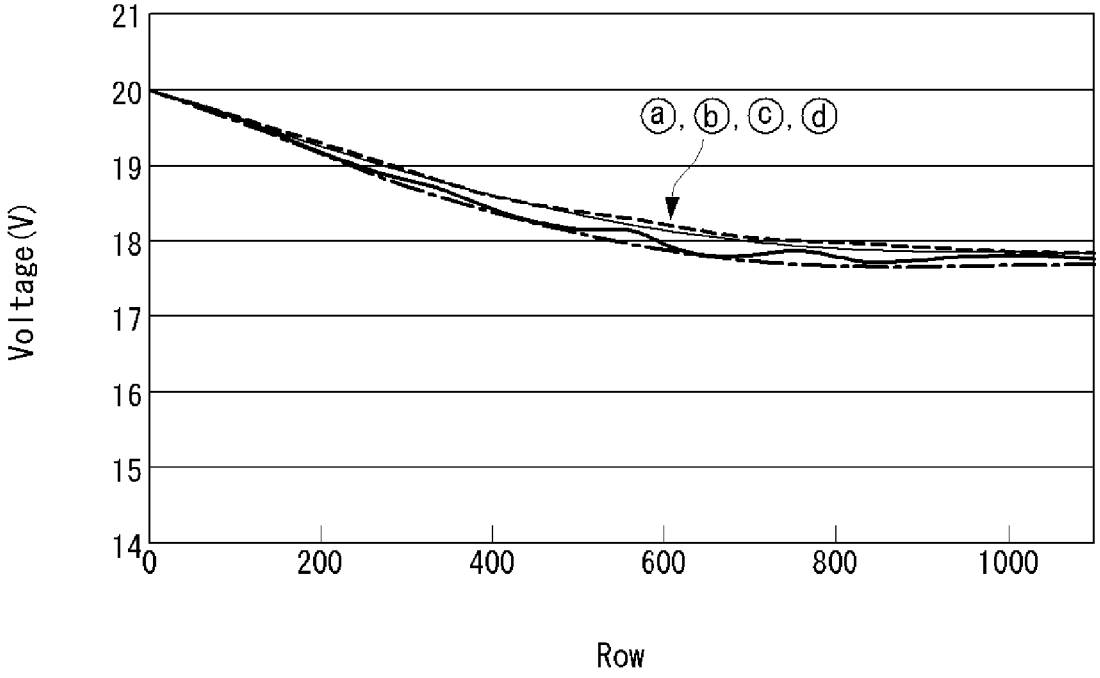
FIGS. 14 and 15 illustrate voltage distributions of power supply lines when the number of ELVDD supply line connection patterns is ten and five, respectively.
Figure 15:
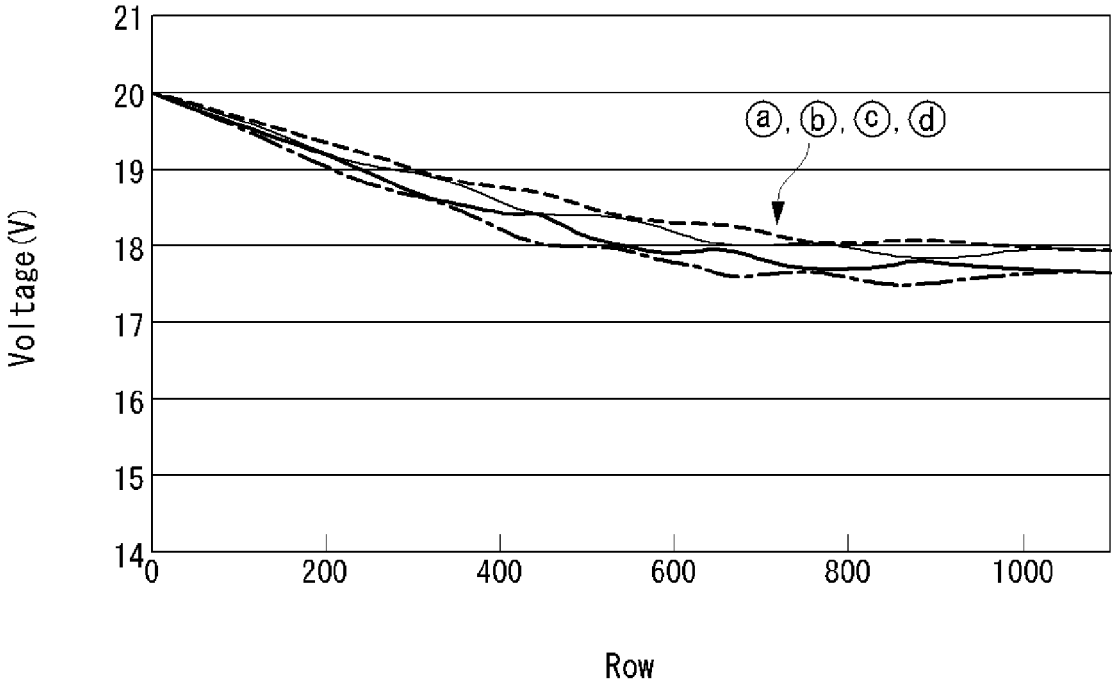

FIGS. 14 and 15 illustrate voltage distributions of the power supply lines when the number of ELVDD supply line connection patterns is ten and five, respectively.

Figure 1:
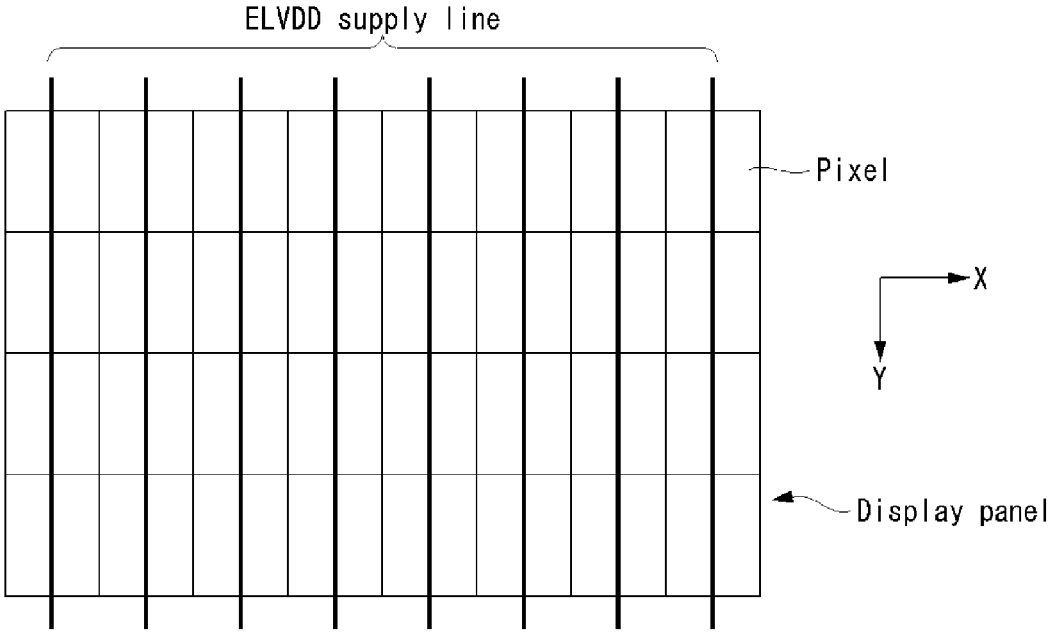
FIG. 1 (RELATED ART)
FIG. 1 shows a general disposition structure of related art ELVDD supply lines.
Figure 2:
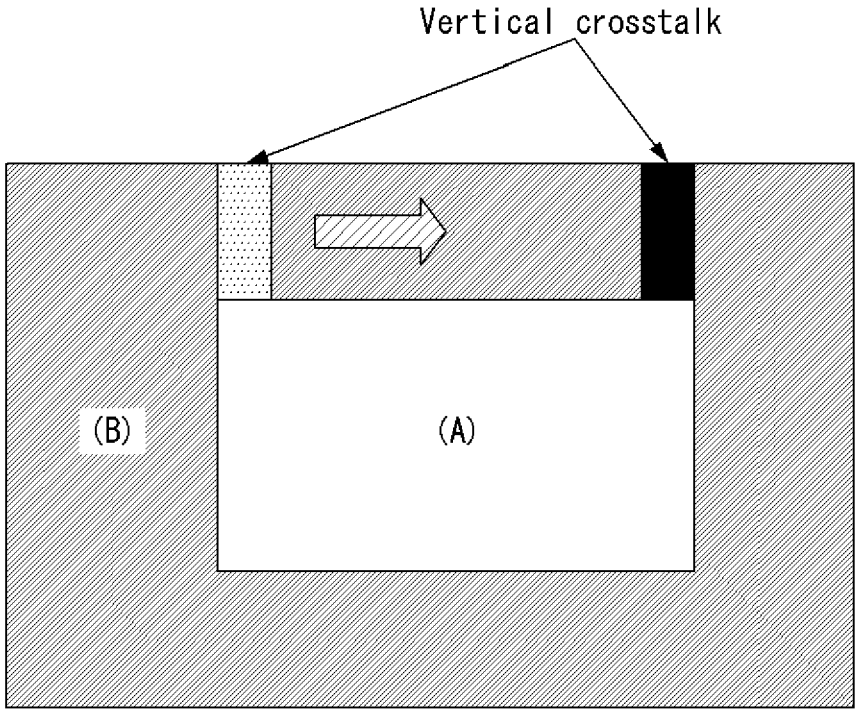
FIG. 2 (RELATED ART)
FIG. 2 shows a vertical crosstalk generated when characteristics of a change amount of voltage of a display panel are affected by a movement of an image pattern in a disposition structure shown in FIG. 1.
Figure 3:
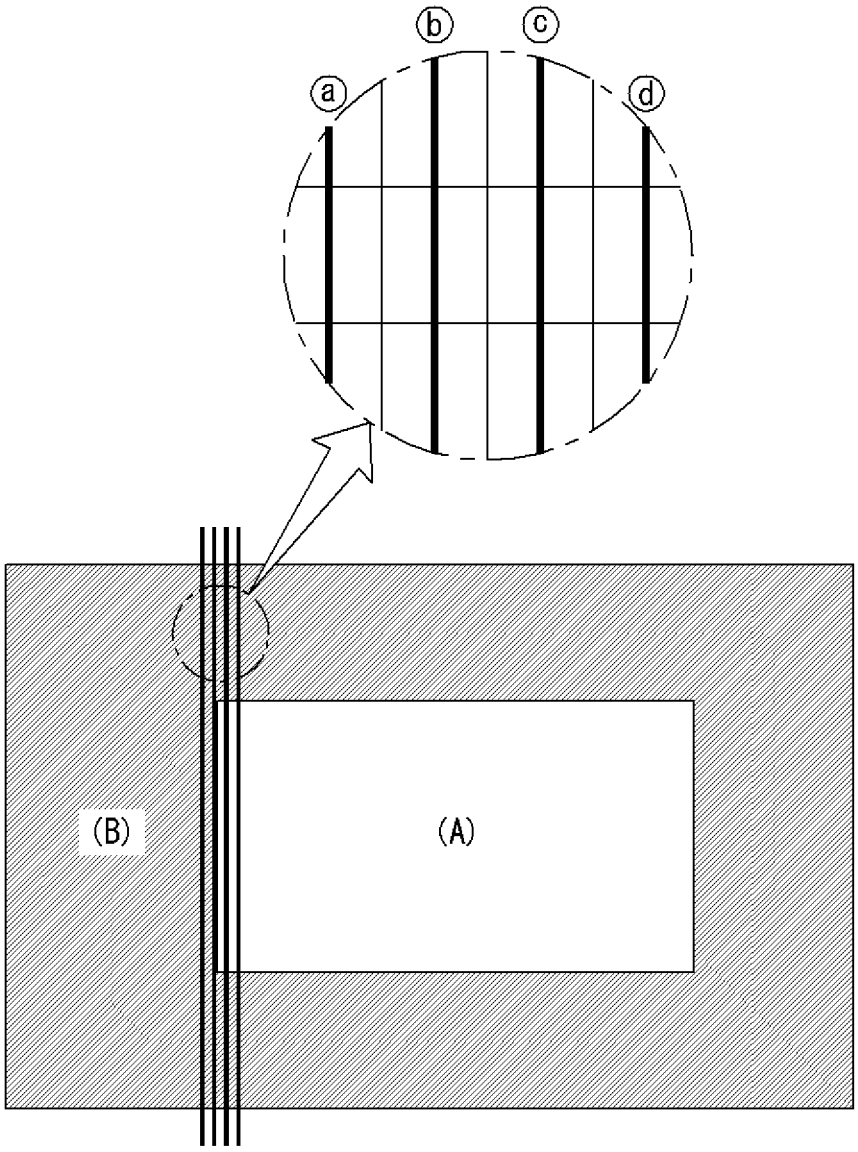
FIG. 3 (RELATED ART)
FIG. 3 enlargedly shows a boundary of a bright image pattern in a measuring pattern of a related art vertical crosstalk.
Figure 4:
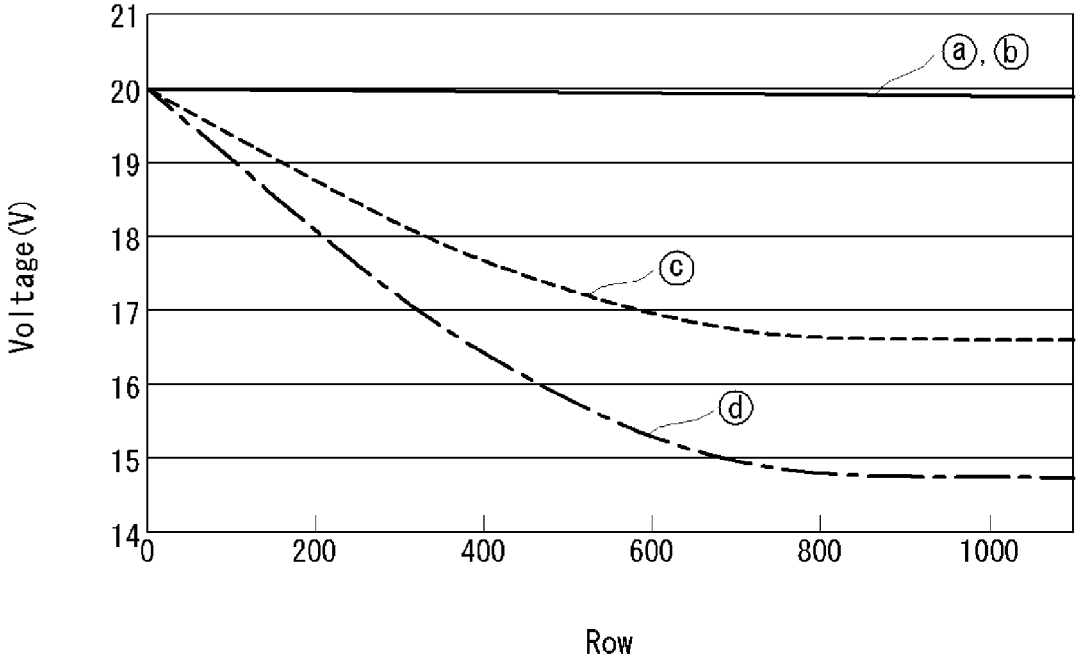
FIG. 4 (RELATED ART)
FIG. 4 shows a voltage distribution of power supply lines at a boundary of a bright image pattern shown in FIG. 3.
Figure 5:
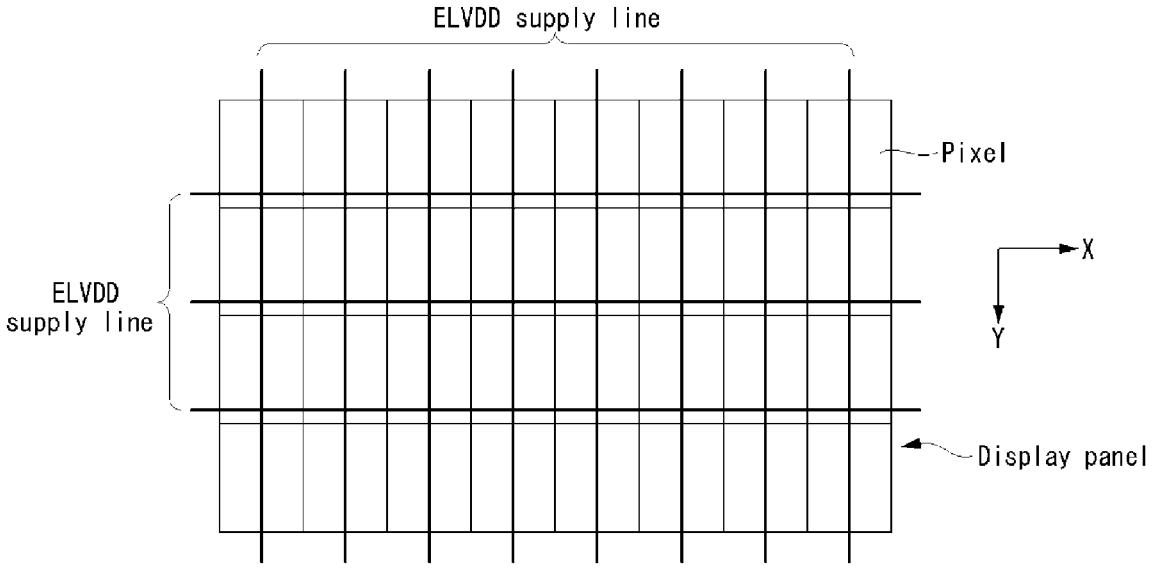
FIG. 5 (RELATED ART)
FIG. 5 shows that related art ELVDD supply lines are disposed in a mesh structure.
Figure 6:
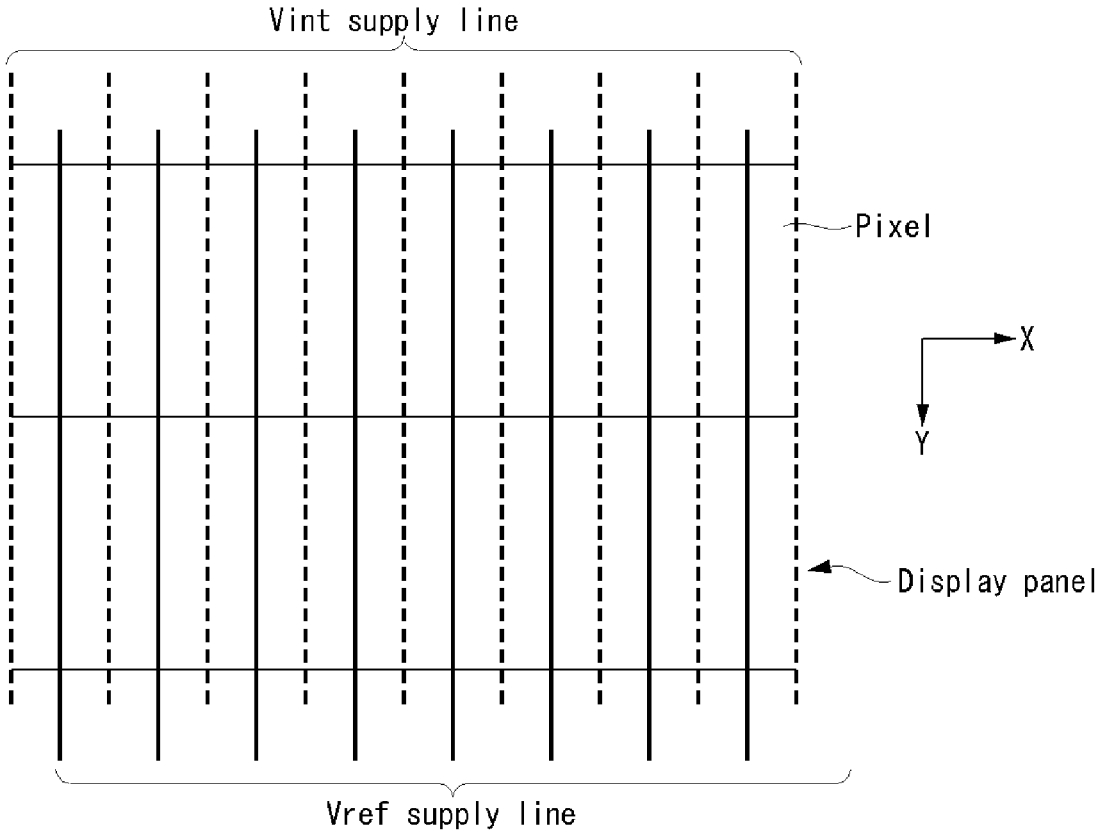
FIG. 6 (RELATED ART)
FIG. 6 shows a general disposition structure of related art auxiliary power supply lines including Vint supply lines and Vref supply lines.
Figure 7:
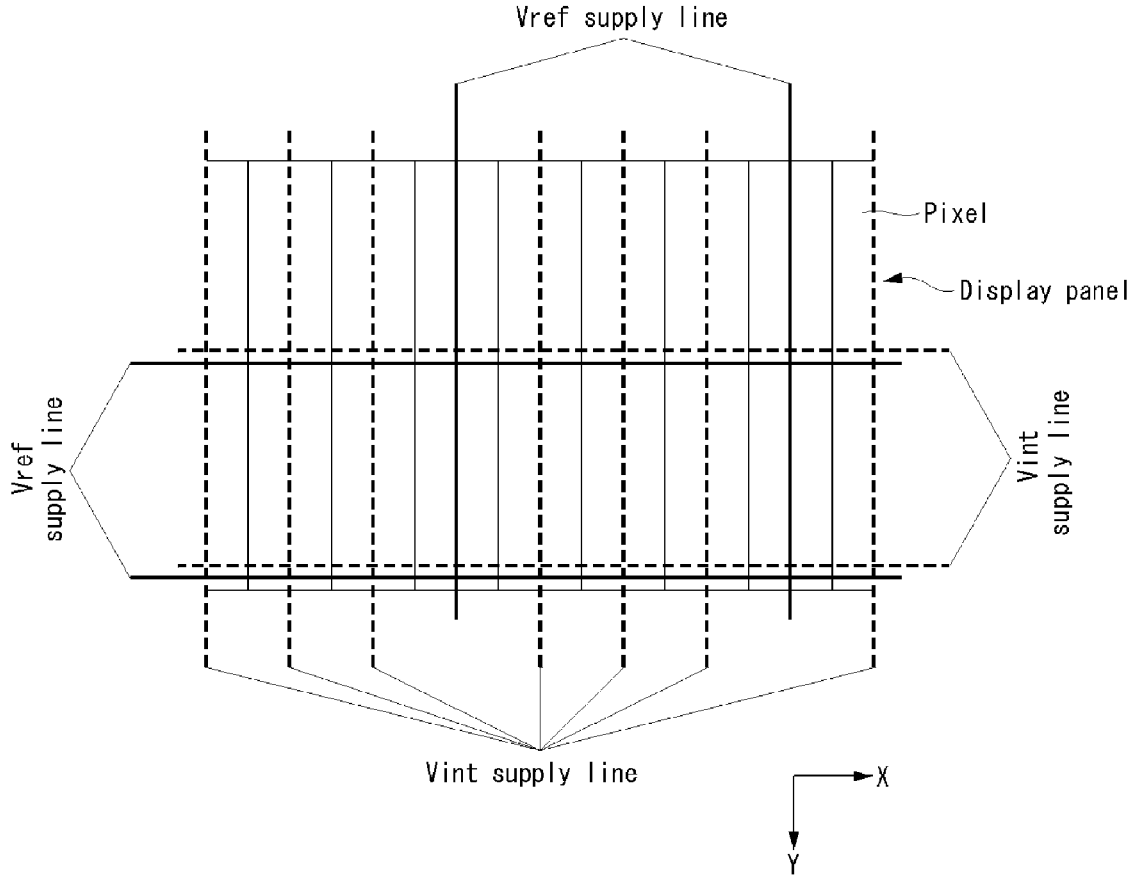
FIG. 7 (RELATED ART)
FIG. 7 shows that related art auxiliary power supply lines are disposed in a mesh structure.
Figure 8:
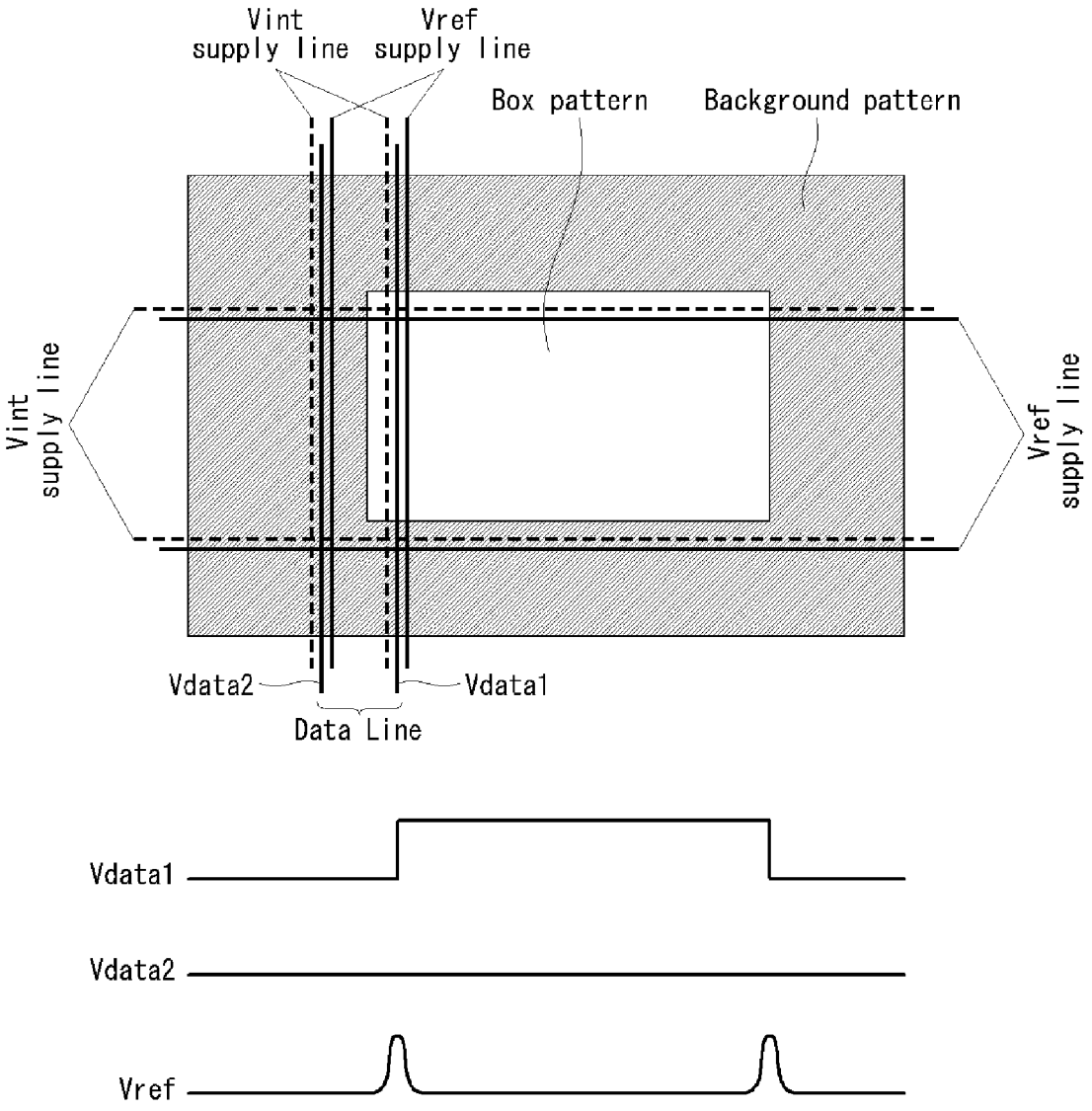
FIG. 8 (RELATED ART)
FIGS. 8 and 9 show that a level of a data voltage sharply changes at a boundary between a background pattern and a box pattern in a disposition structure shown in FIG. 7.
Figure 9:
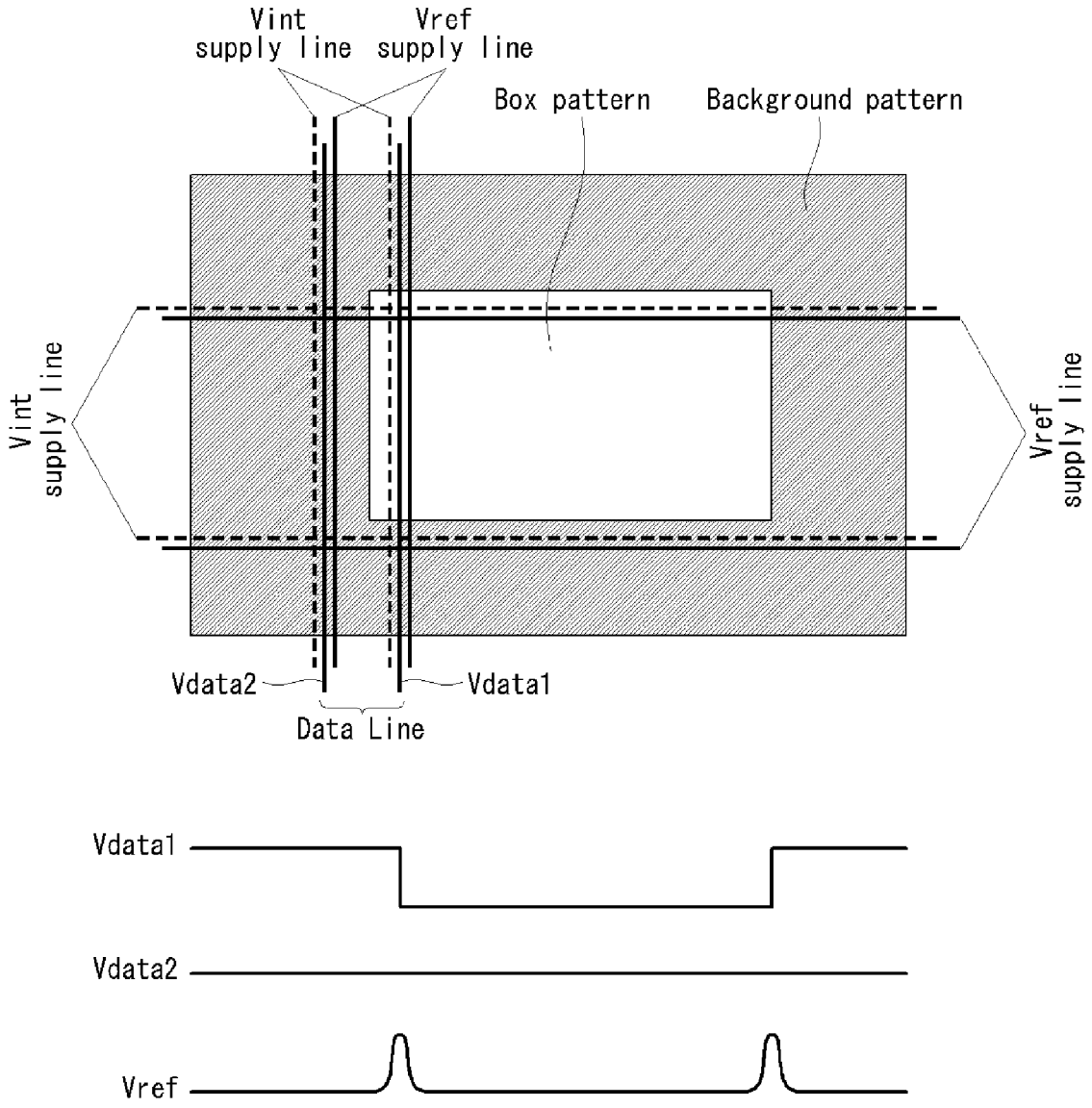
FIG. 9 (RELATED ART)
Figure 10:
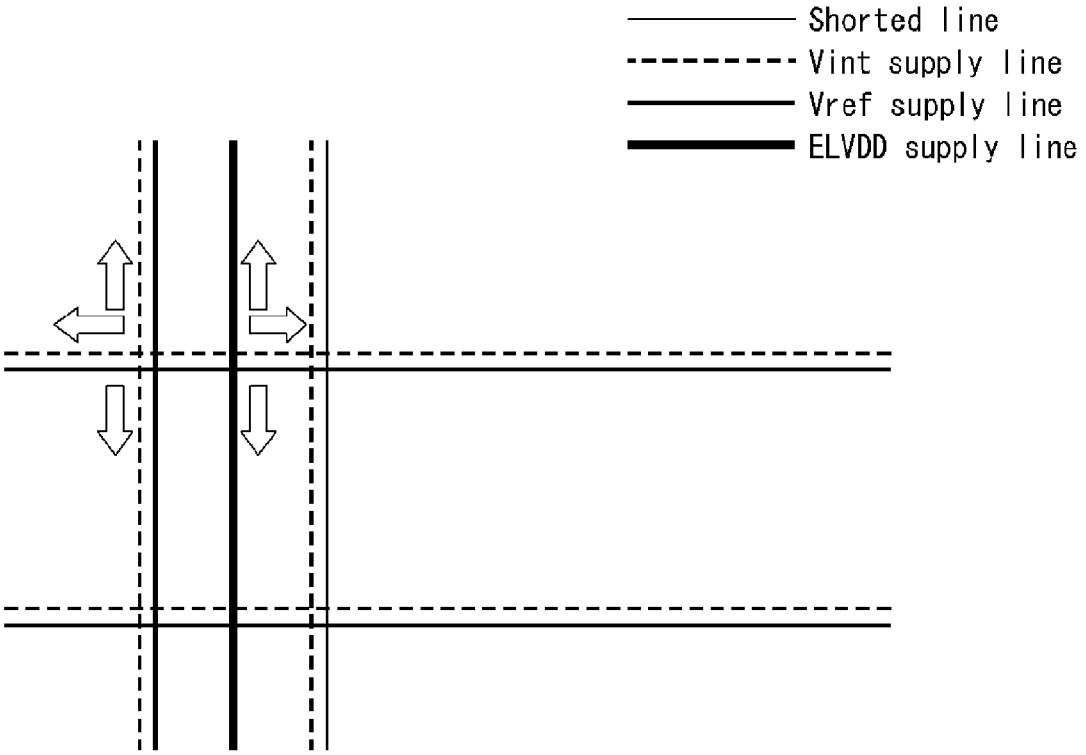
FIG. 10 (RELATED ART)
FIG. 10 shows that heat generated by a short of lines is diffused in a disposition structure shown in FIG. 7.

FIG. 14 illustrates a voltage distribution of the power supply lines based on the boundary of the bright image pattern shown in FIG. 3 when the ELVDD supply line part, in which the number of ELVDD supply line connection patterns positioned between the two adjacent power supply lines is ten, forms the semi-mesh structure. FIG. 15 illustrates a voltage distribution of the power supply lines based on the boundary of the bright image pattern shown in FIG. 3 when the ELVDD supply line part, in which the number of ELVDD supply line connection patterns positioned between the two adjacent power supply lines is five, forms the semi-mesh structure. The inventors found through experiments that as the number of ELVDD supply line connection patterns is increased, the changes in current of the pixel caused by the voltage drop are decreased. When the number of ELVDD supply line connection patterns is equal to or greater than five, a hold percentage of the high potential cell driving voltage ELVDD in the pixel responding to the voltage drop of 1V was about 70%. Therefore, a moving vertical crosstalk may be prevented or reduced. However, when the number of ELVDD supply line connection patterns is increased to as many as the resolution of the display panel as in the related art mesh structure, a diffusion of burning becomes a problem. Therefore, as described above, it is preferable, but not required, that the number of ELVDD supply line connection patterns is about 5 to about 20 when the vertical resolution of the display panel is '1080.'

Figure 16:
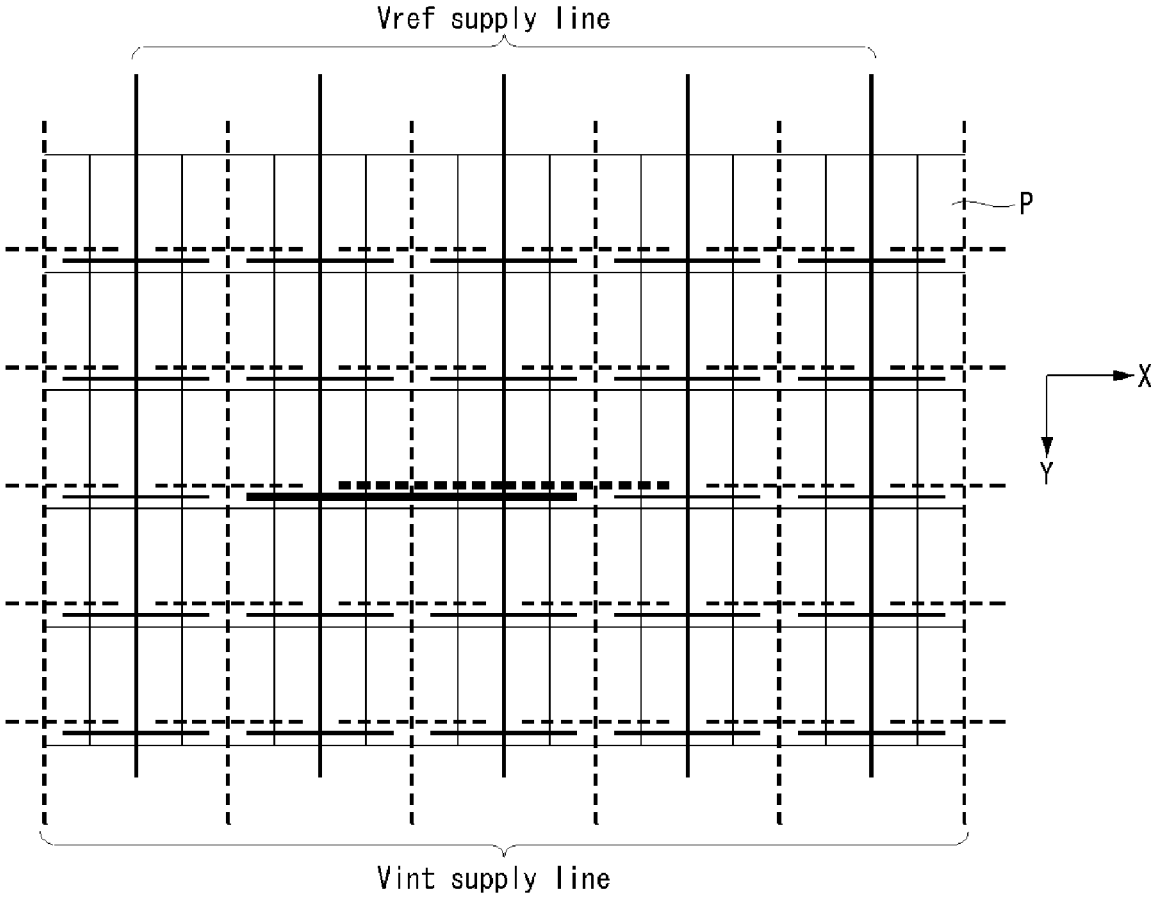
FIG. 16 illustrates a disposition structure of an auxiliary power supply line part according to an exemplary embodiment of the invention.
Figure 17A:
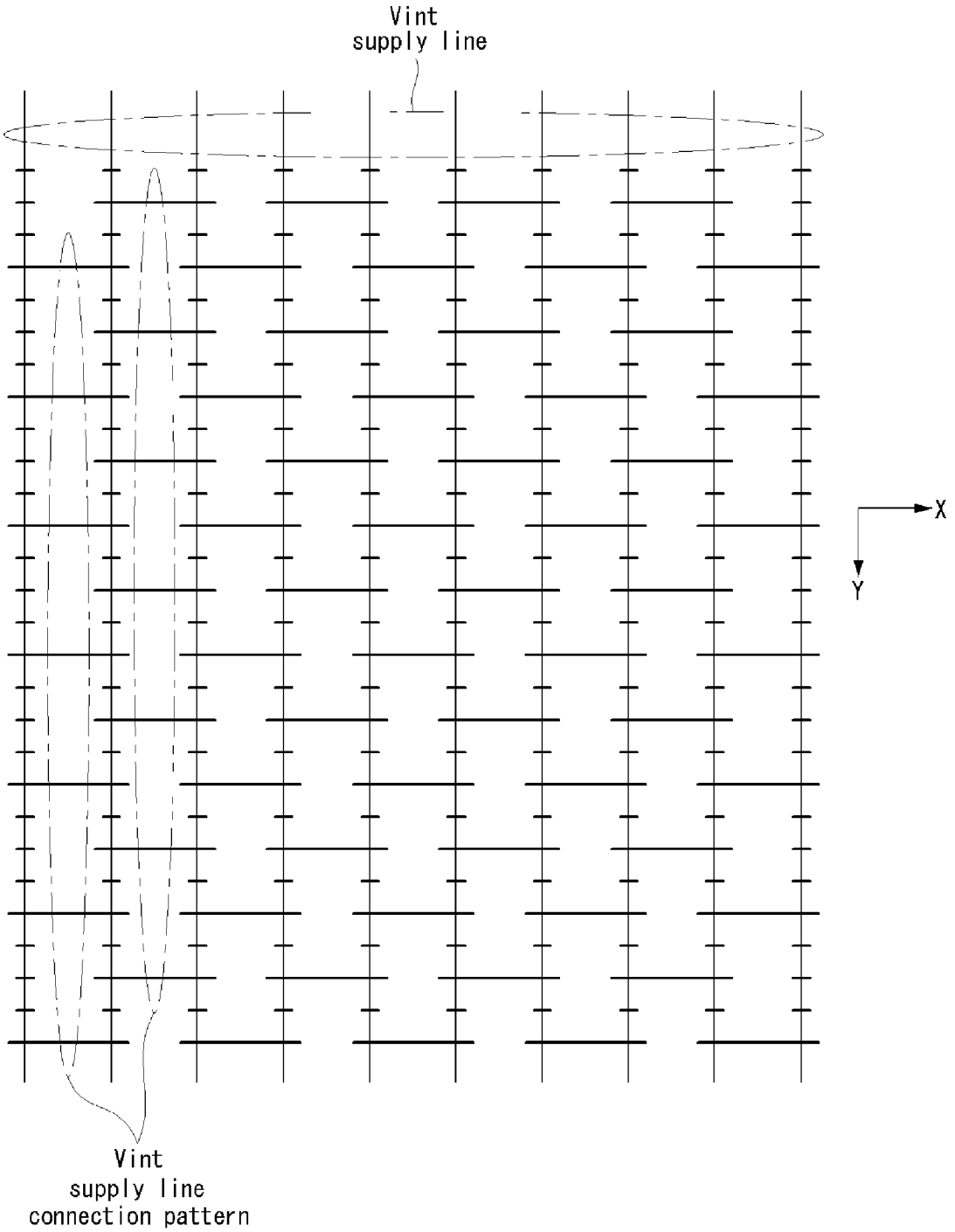
FIGS. 17A and 17B illustrate disposition structures of a Vint supply line part separated from an auxiliary power supply line part shown in FIG. 16.
Figure 17B:
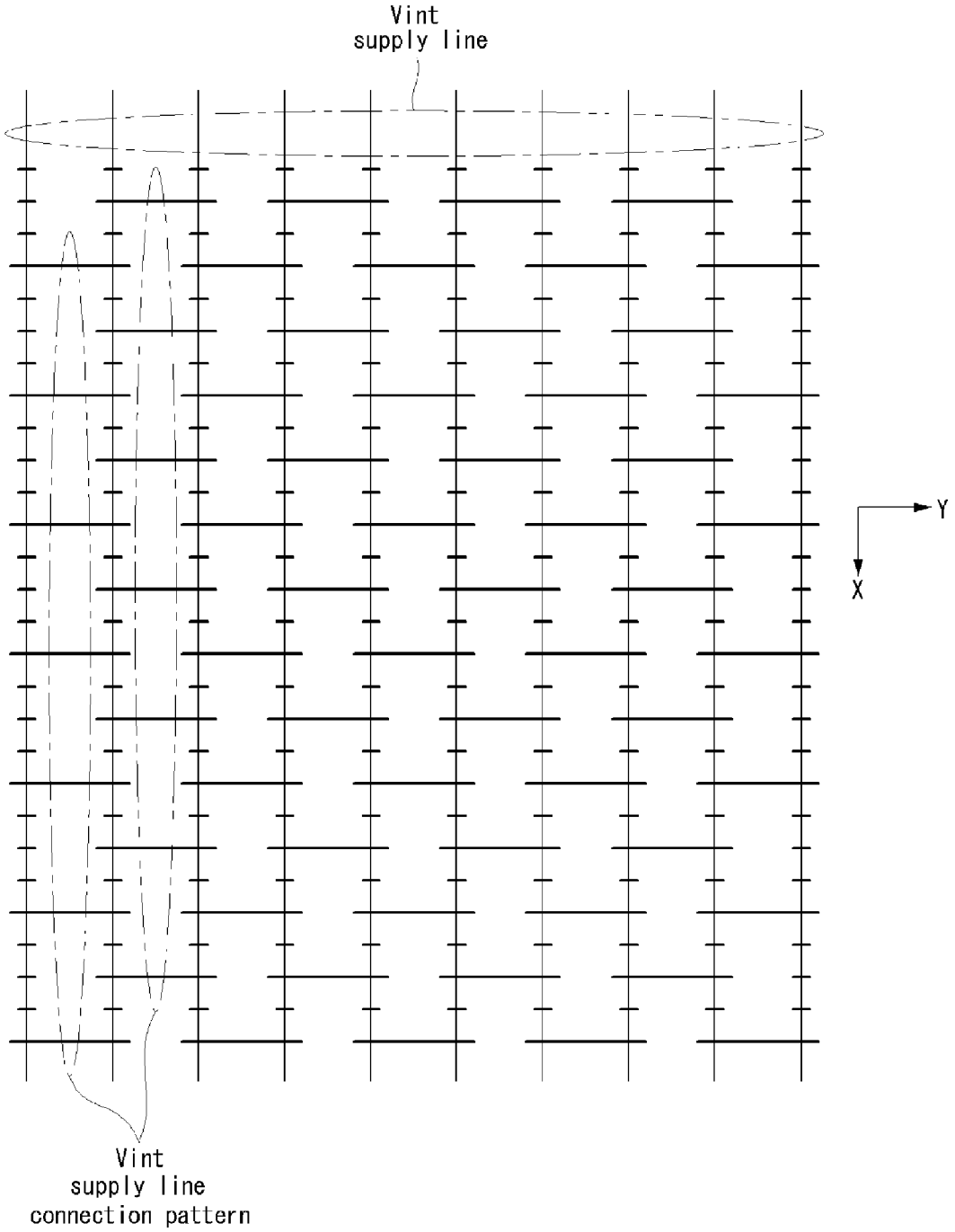
Figure 18A:
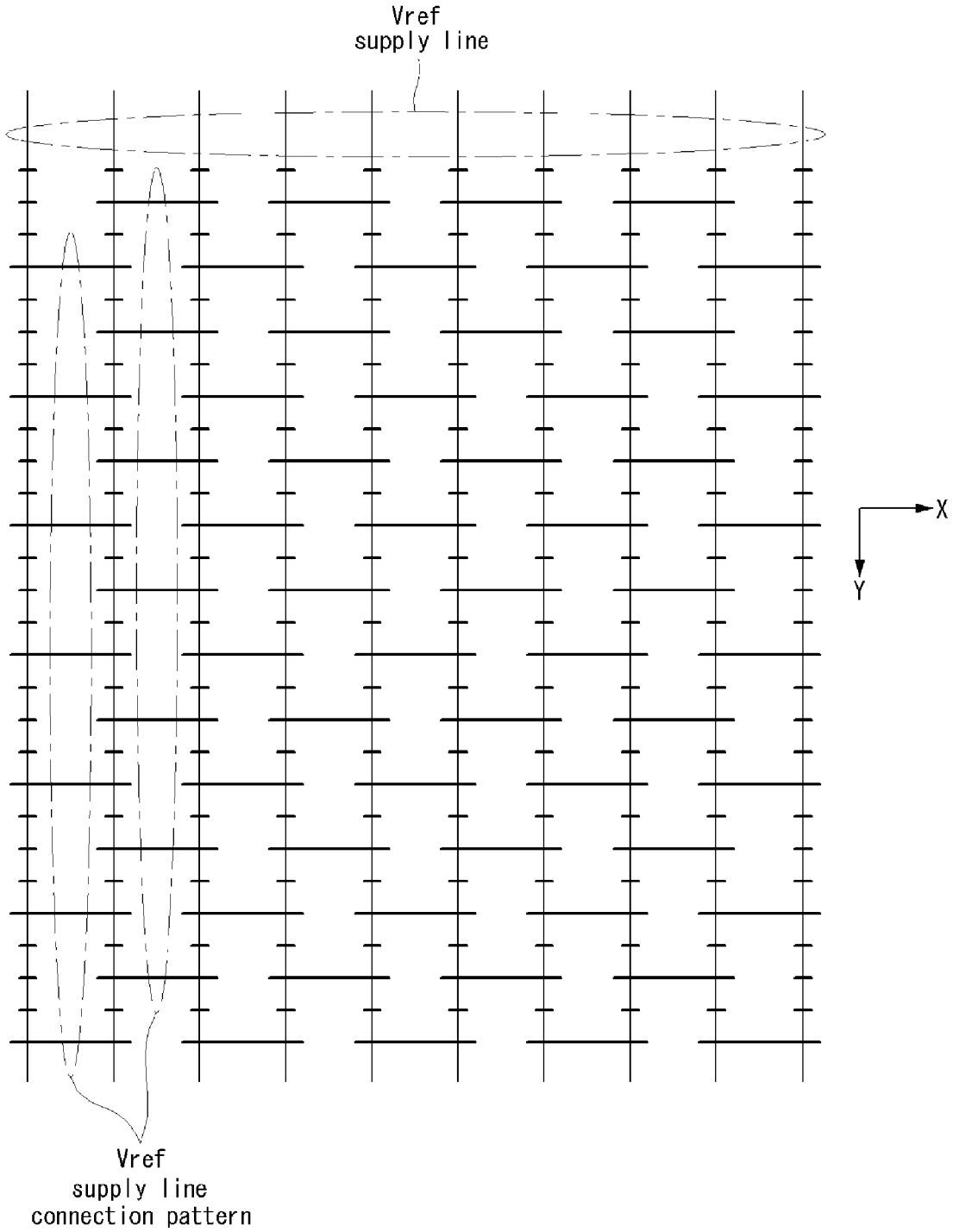
FIGS. 18A and 18B illustrate disposition structures of a Vref supply line part separated from an auxiliary power supply line part shown in FIG. 16.
Figure 18B:
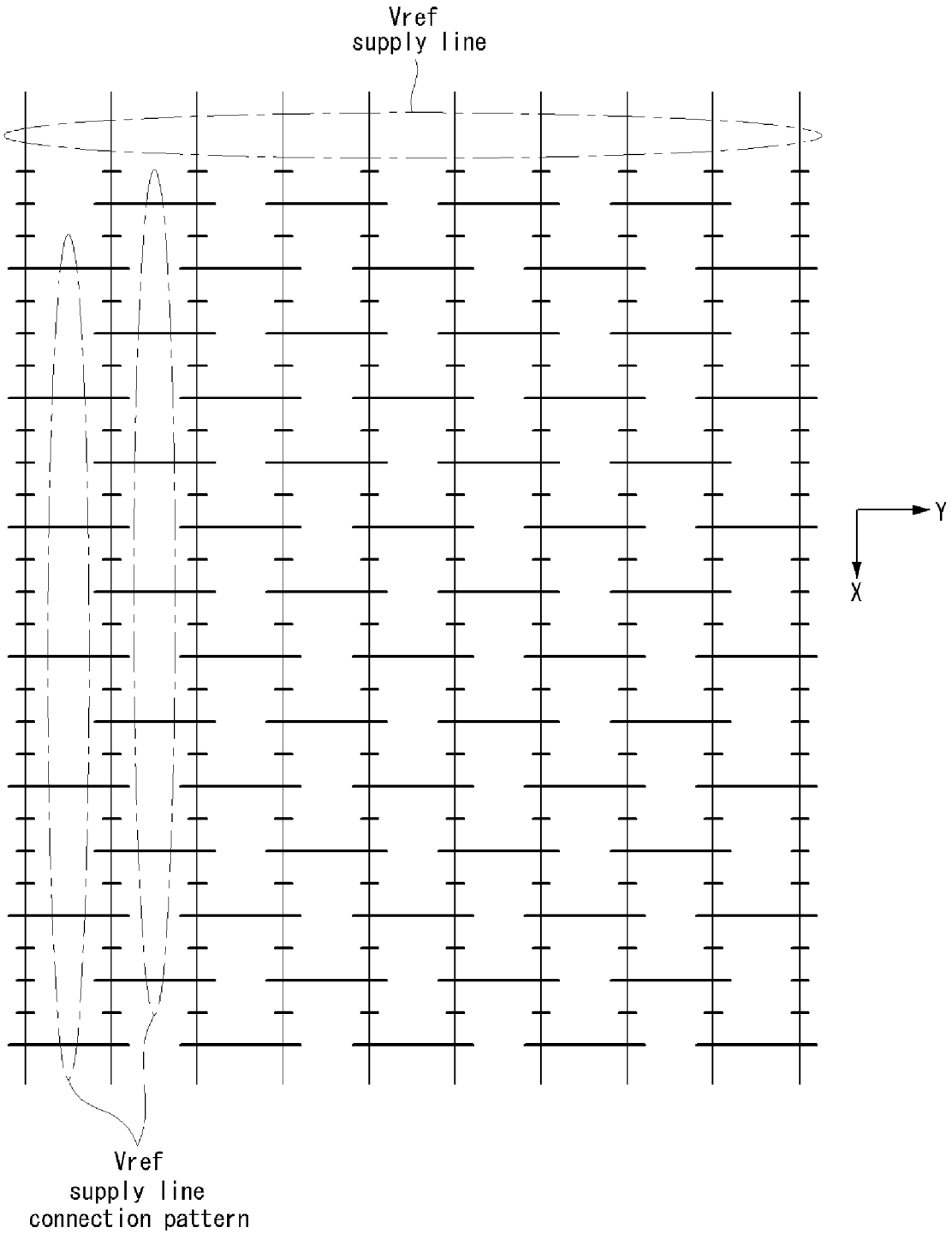

FIG. 16 illustrates a disposition structure of the auxiliary power supply line part according to an embodiment of the invention. FIGS. 17A and 17B illustrate disposition structures of the Vint supply line part. FIGS. 18A and 18B illustrate disposition structures of the Vref supply line part.

The auxiliary power supply line part according to an embodiment of the invention includes the Vint supply line part and the Vref supply line part. Each of the Vint supply line part and the Vref supply line part is implemented in a semi-mesh structure so as to minimize an amount of voltage change and a diffusion of burning.

As shown in FIGS. 16 and 17A, the Vint supply line part according to an embodiment of the invention includes a plurality of Vint supply lines disposed along the Y-axis direction and Vint supply line connection patterns for connecting the adjacent Vint supply lines along the X-axis direction and thus forms the semi-mesh structure. In this instance, the Vint supply line connection patterns are staggered along the X-axis direction, thereby lengthening the thermal transfer path in the X-axis direction and increasing the line resistance in the X-axis direction.

One Vint supply line may be positioned in every at least two pixels. For example, as shown in FIG. 16, one Vint supply line may be positioned in every four pixels so as to improve the aperture ratio. The Vint supply line connection patterns may be disposed between first and second Vint supply lines which are positioned adjacent to each other in the X-axis direction. In this instance, the number of Vint supply line connection patterns between the first and second Vint supply lines may be less than the vertical resolution of the display panel. For example, when the vertical resolution of the display panel is '1080', the 5 to 20 Vint supply line connection patterns may be disposed between the first and second adjacent Vint supply lines. The number of Vint supply line connection patterns is preferably selected within a range less than the vertical resolution of the display panel, thereby reducing capacitance couplings between the Vint supply line connection patterns and the data lines and a diffusion of burning. The Vint supply line connection patterns may be disposed between the first and second Vint supply lines, which are adjacently positioned in the X-axis direction, at regular intervals or at irregular intervals along the Y-axis direction.

Alternatively, as shown in FIG. 17B, the Vint supply line part according to an embodiment of the invention includes a plurality of Vint supply lines disposed along the X-axis direction and Vint supply line connection patterns for connecting the adjacent Vint supply lines along the Y-axis direction and thus may form a semi-mesh structure. In this instance, the Vint supply line connection patterns are staggered along the Y-axis direction, thereby lengthening the thermal transfer path in the Y-axis direction and increasing the line resistance in the Y-axis direction.

As shown in FIGS. 16 and 18A, the Vref supply line part according to an embodiment of the invention includes a plurality of Vref supply lines disposed along the Y-axis direction and Vref supply line connection patterns for connecting the adjacent Vref supply lines along the X-axis direction and thus forms a semi-mesh structure. In this instance, the Vref supply line connection patterns are staggered along the X-axis direction, thereby lengthening the thermal transfer path in the X-axis direction and increasing the line resistance in the X-axis direction.

One Vref supply line may be positioned in every at least two pixels. For example, as shown in FIG. 16, one Vref supply line may be positioned in every four pixels so as to improve the aperture ratio. The Vref supply line connection patterns may be disposed between first and second Vref supply lines which are positioned adjacent to each other in the X-axis direction. In this instance, the number of Vref supply line connection patterns between the first and second Vref supply lines may be less than the vertical resolution of the display panel. For example, when the vertical resolution of the display panel is '1080', the 5 to 20 Vref supply line connection patterns may be disposed between the first and second adjacent Vref supply lines. The number of Vref supply line connection patterns is preferably selected within a range less than the vertical resolution of the display panel, thereby reducing capacitance couplings between the Vref supply line connection patterns and the data lines and a diffusion of burning. The Vref supply line connection patterns may be disposed between the first and second Vref supply lines, which are adjacently positioned in the X-axis direction, at regular intervals or at irregular intervals along the Y-axis direction.

Alternatively, as shown in FIG. 18B, the Vref supply line part according to an embodiment of the invention includes a plurality of Vref supply lines disposed along the X-axis direction and Vref supply line connection patterns for connecting the adjacent Vref supply lines along the Y-axis direction and thus may form a semi-mesh structure. In this instance, the Vref supply line connection patterns are staggered along the Y-axis direction, thereby lengthening the thermal transfer path in the Y-axis direction and increasing the line resistance in the Y-axis direction.

As described above, the embodiment of the invention configures the main power supply line part and/or the auxiliary power supply line part in a semi-mesh structure, thereby minimizing a reduction in image quality resulting from the voltage change and efficiently preventing or minimizing the diffusion of burning problem.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An active matrix organic light emitting display comprising:

a plurality of pixels formed at crossings of data lines and gate line parts, each pixel including an organic light emitting diode (OLED), a driving thin film transistor (TFT), a switching TFT, and a capacitor; and a main power supply line part configured to supply a cell driving voltage to the pixels and including a plurality of main power supply lines extended along a first direction and a plurality of main power supply line connection patterns for connecting adjacent main power supply lines along a second direction substantially perpendicular to the first direction, wherein the main power supply line connection patterns are staggered on a regular, repeated basis of an integer multiple of a pitch of the plurality of pixels along the second direction.

2. The organic light emitting display of claim 1, wherein the main power supply line part includes an ELVDD supply line part configured to supply a high potential cell driving voltage ELVDD to the pixels and an ELVSS supply line part configured to supply a low potential cell driving voltage ELVSS to the pixels, wherein the main power supply line connection patterns include ELVDD supply line connection patterns for connecting adjacent ELVDD supply lines extending in the first direction along the second direction and ELVSS supply line connection patterns for connecting adjacent ELVSS supply lines extending in the first direction along the second direction.

3. The organic light emitting display of claim 2, wherein a number of ELVDD supply line connection patterns disposed between first and second ELVDD supply lines, which are positioned adjacent to each other in the second direction, is less than a vertical resolution of a display panel.

4. The organic light emitting display of claim 3, wherein when the vertical resolution of the display panel is '1080', the number of ELVDD supply line connection patterns disposed between the first and second ELVDD supply lines is about 5 to about 20.

5. The organic light emitting display of claim 3, wherein the ELVDD supply line connection patterns are disposed between the first and second ELVDD supply lines at regular intervals along the first direction.

6. The organic light emitting display of claim 3, wherein the ELVDD supply line connection patterns are disposed between the first and second ELVDD supply lines at irregular intervals along the first direction.

7. The organic light emitting display of claim 2, wherein a hold percentage of the high potential cell driving voltage ELVDD in the pixels responding to a voltage drop of 1V is at least about 70%.

8. The organic light emitting display of claim 1, further comprising:

a Vint supply line part configured to supply an initialization voltage Vint to the pixels, the Vint supply line part including a plurality of Vint supply lines extended along the first direction and Vint supply line connection patterns for connecting adjacent Vint supply lines along the second direction; and a Vref supply line part configured to supply a reference voltage Vref to the pixels, the Vref supply line part including a plurality of Vref supply lines extended along the first direction and Vref supply line connection patterns for connecting adjacent Vref supply lines along the second direction, wherein the Vint supply line connection patterns are staggered along the second direction, and the Vref supply line connection patterns are staggered along the second direction.

9. The organic light emitting display of claim 8, wherein a number of Vint supply line connection patterns disposed between first and second Vint supply lines, which are positioned adjacent to each other in the second direction, is less than a vertical resolution of a display panel, wherein a number of Vref supply line connection patterns disposed between first and second Vref supply lines, which are positioned adjacent to each other in the second direction, is less than the vertical resolution of the display panel.

10. The organic light emitting display of claim 9, wherein when the vertical resolution of the display panel is '1080', the number of Vint supply line connection patterns disposed between the first and second Vint supply lines is about 5 to about 20, and the number of Vref supply line connection patterns disposed between the first and second Vref supply lines is about 5 to about 20.

11. The organic light emitting display of claim 9, wherein the Vint supply line connection patterns are disposed between the first and second Vint supply lines at regular intervals along the first direction, wherein the Vref supply line connection patterns are disposed between the first and second Vref supply lines at regular intervals along the first direction.

12. The organic light emitting display of claim 9, wherein the Vint supply line connection patterns are disposed between the first and second Vint supply lines at irregular intervals along the first direction, wherein the Vref supply line connection patterns are disposed between the first and second Vref supply lines at irregular intervals along the first direction.

13. The organic light emitting display of claim 1, wherein the first direction indicates a Y-axis direction in which the data lines extend, and the second direction indicates an X-axis direction in which the gate line parts extend.

14. The organic light emitting display of claim 1, wherein the first direction indicates an X-axis direction in which the gate line parts extend, and the second direction indicates a Y-axis direction in which the data lines extend.

15. The organic light emitting display of claim 1, wherein the main power supply line part forms a semi-mesh structure.

16. The organic light emitting display of claim 1, wherein the main power supply line connection patterns are spaced apart from each other at regular intervals in the first and second directions.

* * * * *